US008049682B2

(12) United States Patent
Park et al.

(10) Patent No.: US 8,049,682 B2
(45) Date of Patent: Nov. 1, 2011

(54) PLASMA DISPLAY DEVICE

(75) Inventors: Ki Rack Park, Gumi-si (KR); Jong Woon Bae, Gumi-si (KR); Seong Hwan Ryu, Gumi-si (KR)

(73) Assignee: LG Electronics Inc., Seoul (KR)

( * ) Notice: Subject to any disclaimer, the term of this patent is extended or adjusted under 35 U.S.C. 154(b) by 560 days.

(21) Appl. No.: 12/264,947

(22) Filed: Nov. 5, 2008

(65) Prior Publication Data

US 2009/0184949 A1 Jul. 23, 2009

(30) Foreign Application Priority Data

Jan. 18, 2008 (KR) ..... 10-2008-0005856

(51) Int. Cl.
*G09G 3/28* (2006.01)

(52) U.S. Cl. ..... 345/60; 345/68; 345/211; 315/169.4

(58) Field of Classification Search ..... 345/37, 345/41, 60–68, 211; 315/169.4; 313/492, 313/582, 584
See application file for complete search history.

(56) References Cited

U.S. PATENT DOCUMENTS 7,492,333 B2 * 2/2009 Lee et al. ..... 345/60
7,649,509 B2 * 1/2010 Chae ..... 345/60

FOREIGN PATENT DOCUMENTS

EP 1 526 498 A2 4/2005
EP 1 821 281 A1 8/2007
WO WO2007009429 A1 1/2007

OTHER PUBLICATIONS

European Search Report dated Feb. 23, 2009 for European Patent Application No. 08253636.8 (11 pages).
Chinese Office Action for Application No. 2008101752645 dated Mar. 17, 2010, 8 pages.

* cited by examiner

*Primary Examiner* — Abbas Abdulselam
(74) *Attorney, Agent, or Firm* — Fish & Richardson P.C.

(57) ABSTRACT

There is provided a plasma display device. The plasma display device includes a plasma display panel (PDP) and a driving unit for generating driving signals for driving the PDP. A period in which sustain signals are supplied to the PDP includes a first period in which sustain signals supplied to the PDP gradually increase from a reference voltage to a first voltage, a second period for sustaining a second voltage higher than the first voltage, a third period gradually falling from the second voltage to a third voltage higher than the reference voltage, and a fourth period for sustaining the reference voltage. The length of the first period is shorter than the length of the third period. The first switch is turned on at a point of time before the magnitude of current that flows through the inductor reaches a maximum value and then, becomes 0 in the first period. In supplying the sustain signals to the PDP, the point of time where the sustain voltage sustain period or the reference voltage sustain period starts is controlled so that the driving margin of the PDP can be secured enough without remarkably increasing the power consumption for the PDP and that the high resolution PDP can be driven at high speed.

20 Claims, 14 Drawing Sheets

PLASMA DISPLAY DEVICE

BACKGROUND OF THE INVENTION

1. Field of the Invention

The present invention relates to a plasma display device, and more particularly, to an energy recovery circuit for supplying driving signals to a plasma display panel (PDP).

2. Discussion of the Related Art

A plasma display panel (PDP) excites a phosphor by vacuum ultraviolet rays (VUV) generated when mixtures of inert gases are discharged to emit light and to display an image.

The PDP can be easily made large, thin, and simple so that the PDP can be easily manufactured and has higher brightness and emission efficiency than other flat panel displays (FPD). In particular, since an alternate current (AC) surface discharge type three electrode PDP has wall charges accumulated on the surface thereof during discharge to protect electrodes from sputtering generated by the discharge, the AC surface discharge type three electrode PDP is driven at a low voltage and has a long life.

The PDP is time division driven in a reset period for initializing all of the cells, an address period for selecting a cell, and a sustain period for generating display discharge in the selected cell in order to realize the gray levels of an image.

In order for a driving circuit to supply driving signals to the PDP, since a plurality of switching elements and clamping diodes are required, the cost and size of the driving circuit increase due to increase in the number of parts and the power consumption of the driving circuit increases due to a plurality of circuit parts.

In addition, in the case of a large screen plasma display device having a high resolution, a time margin for driving the PDP is insufficient so that it is necessary to drive the PDP at high speed.

SUMMARY OF THE INVENTION

In order to solve the above-described problems, it is an object of the present invention to provide a plasma display device capable of securing the driving margin of a plasma display panel (PDP) and of improving power consumption.

In order to achieve the above object, the plasma display device according to the present invention includes a plasma display panel (PDP) and a driving unit for generating driving signals for driving the PDP. A period in which sustain signals are supplied to the PDP includes a first period in which sustain signals supplied to the PDP gradually increase from a reference voltage to a first voltage, a second period for sustaining a second voltage higher than the first voltage, a third period gradually falling from the second voltage to a third voltage higher than the reference voltage, and a fourth period for sustaining the reference voltage. The driving unit includes an energy recovery circuit consisting of an inductor for forming a resonance circuit together with the capacitance of the PDP, a first switch turned on to supply the second voltage to the PDP, and a second switch turned on to supply the reference voltage to the PDP. The length of the first period is shorter than the length of the third period. The first switch is turned on at a point of time before the magnitude of current that flows through the inductor reaches a maximum value and then, becomes 0 in the first period.

In another plasma display device according to the present invention, the length of the first period is shorter than the length of the third period. The first switch is turned on at the point of time at which the magnitude of current that flows through the inductor reaches a maximum value and then, becomes 0.5 times to 0.85 times the maximum value in the first period.

DETAILED DESCRIPTION OF THE PREFERRED EMBODIMENTS

Figure 1:
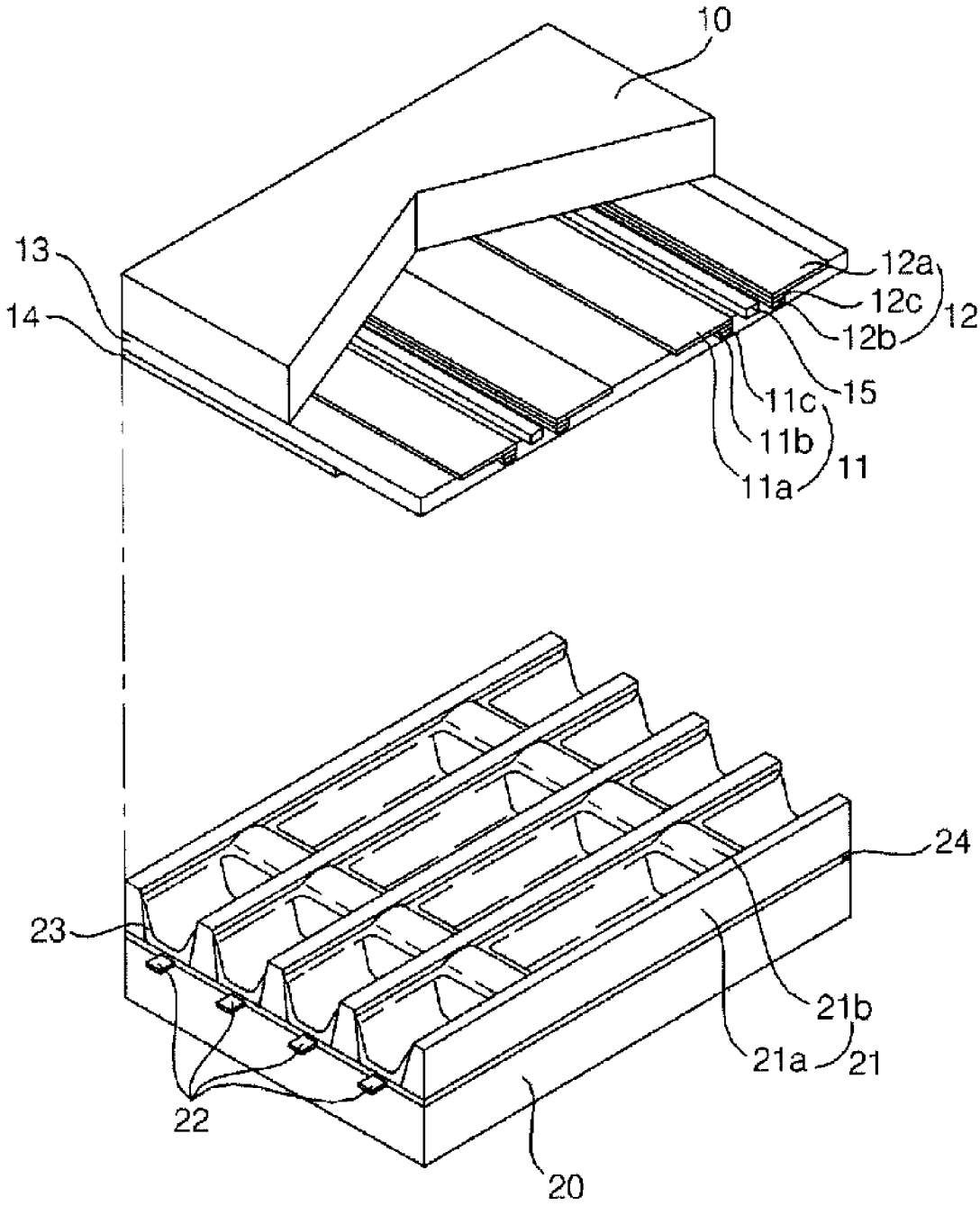
FIG. 1 is a perspective view illustrating the structure of a plasma display panel (PDP) according to an embodiment of the present invention.

Hereinafter, an energy recovery circuit according to the present invention and a plasma display device using the same according to the present invention will be described in detail with reference to the accompanying drawings. FIG. 1 is a perspective view illustrating the structure of a plasma display panel (PDP) according to an embodiment of the present invention.

As illustrated in FIG. 1, the PDP includes scan electrodes 11 and sustain electrodes 12 that are pairs of sustain electrodes formed on an upper substrate 10 and address electrodes 22 formed on a lower substrate 20.

The pairs of sustain electrodes 11 and 12 commonly include transparent electrodes 11*a* and 12*a* and bus electrodes 11*b* and 12*b* formed of indium tin oxide (ITO). The bus electrodes 11*b* and 12*b* can be formed of metal such as Ag and Cr, a lamination of Cr/Cu/Cr, or a lamination of Cr/Al/Cr. The bus electrodes 11*b* and 12*b* are formed on the transparent electrodes 11*a* and 12*a* to reduce reduction in a voltage that is caused by the transparent electrodes 11*a* and 12*a* having high resistance.

On the other hand, according to an embodiment of the present invention, the pairs of sustain electrodes 11 and 12 can be formed of only the bus electrodes 11*b* and 12*b* without the transparent electrodes 11*a* and 12*a* as well as a lamination of the transparent electrodes 11*a* and 12*a* and the bus electrodes 11*b* and 12*b*. In such a structure, since the transparent electrodes 11*a* and 12*a* are not used, the cost of manufacturing the PDP can be reduced. The bus electrodes 11*b* and 12*b* used for the structure can be formed of various materials such as a photosensitive material other than the above mentioned materials.

Black matrixes BM 15 having a light shielding function of absorbing external light generated in the outside of the upper substrate 10 to reduce reflection and a function of improving the purity and contrast of the upper substrate 10 are provided between the transparent electrodes 11*a* and 12*a* and the bus electrodes 11*b* and 11*c* of the scan electrodes 11 and the sustain electrodes 12.

The black matrixes 15 according to an embodiment of the present invention are formed on the upper substrate 10 and can consist of first black matrixes 15 formed to overlap barrier ribs 21 and second black matrixes 11*c* and 12*c* formed between the transparent electrodes 11*a* and 12*a* and the bus electrodes 11*b* and 12*b*. Here, the first black matrixes 15 and the second black matrixes 11*c* and 12*c* referred to as a black layer or a black electrode layer can be simultaneously formed to be physically connected to each other and may not be simultaneously formed not to be physically connected to each other.

In addition, when the first black matrixes 15 and the second black matrixes 11*c* and 12*c* are physically connected to each other, the first black matrixes 15 and the second black matrixes 11*c* and 12*c* are formed of the same material. However, when the first black matrixes 15 and the second black matrixes 11*c* and 12*c* are physically separated from each other, the first black matrixes 15 and the second black matrixes 11*c* and 12*c* can be formed of different materials.

An upper dielectric layer 13 and a protective layer 14 are laminated on the upper substrate 10 where the scan electrodes 11 and the sustain electrodes 12 run parallel to each other. Charged particles generated by discharge are accumulated on the upper dielectric layer 13 to protect the pairs of sustain electrodes 11 and 12. The protective layer 14 protects the upper dielectric layer 13 against the sputtering of the charged particles generated during gas discharge and improves the emission efficiency of secondary electrons.

In addition, the address electrodes 22 are formed to intersect the scan electrodes 11 and the sustain electrodes 12. In addition, a lower dielectric layer 24 and the barrier ribs 21 are formed on the lower substrate 20 where the address electrodes 22 are formed.

In addition, phosphor layers 23 are formed on the surfaces of the lower dielectric layer 24 and the barrier ribs 21. The barrier ribs 21 in which vertical barrier ribs 21*a* and horizontal barrier ribs 21*b* are formed to be closed physically divide discharge cells from each other and prevent the ultraviolet (UV) rays and visible rays generated by discharge from leaking to adjacent discharge cells.

According to an embodiment of the present invention, the barrier ribs 21 can have various structures as well as the structure illustrated in FIG. 1. For example, the barrier ribs 21 can have a differential barrier rib structure in which the height of the vertical barrier ribs 21*a* is different from the height of the horizontal barrier ribs 21*b*, a channel type barrier rib structure in which a channel that can be used as an exhaust path is formed in at least one of the vertical barrier ribs 21*a* and the horizontal barrier ribs 21*b*, and a hollow type barrier rib structure in which a hollow is formed in at least one of the vertical barrier ribs 21*a* and the horizontal barrier ribs 21*b*.

Here, in the differential barrier rib structure, the height of the horizontal barrier ribs 21*b* is preferably higher than the height of the vertical barrier ribs 21*a*. In the channel type barrier rib structure or the hollow type barrier rib structure, the channel or the hollow is preferably formed in the horizontal barrier ribs 21*b*.

On the other hand, according to an embodiment of the present invention, it is described that R, G, and B discharge cells are arranged on the same line, however, can be arranged in other forms. For example, delta type arrangement in which the R, G, and B discharge cells are triangularly arranged can be performed. In addition, the shape of the discharge cell can be various polygons such as a pentagon and a hexagon as well as a square.

In addition, the phosphor layers 23 emit light by the UV rays generated during the gas discharge to generate on visible ray among red R, green G, and blue B visible rays. Here, mixtures of inert gases such as He+Xe, Ne+Xe, and He+Ne+Xe for discharge are implanted into discharge spaces provided among the upper and lower substrates 10 and 20 and the barrier ribs 21.

Figure 2:
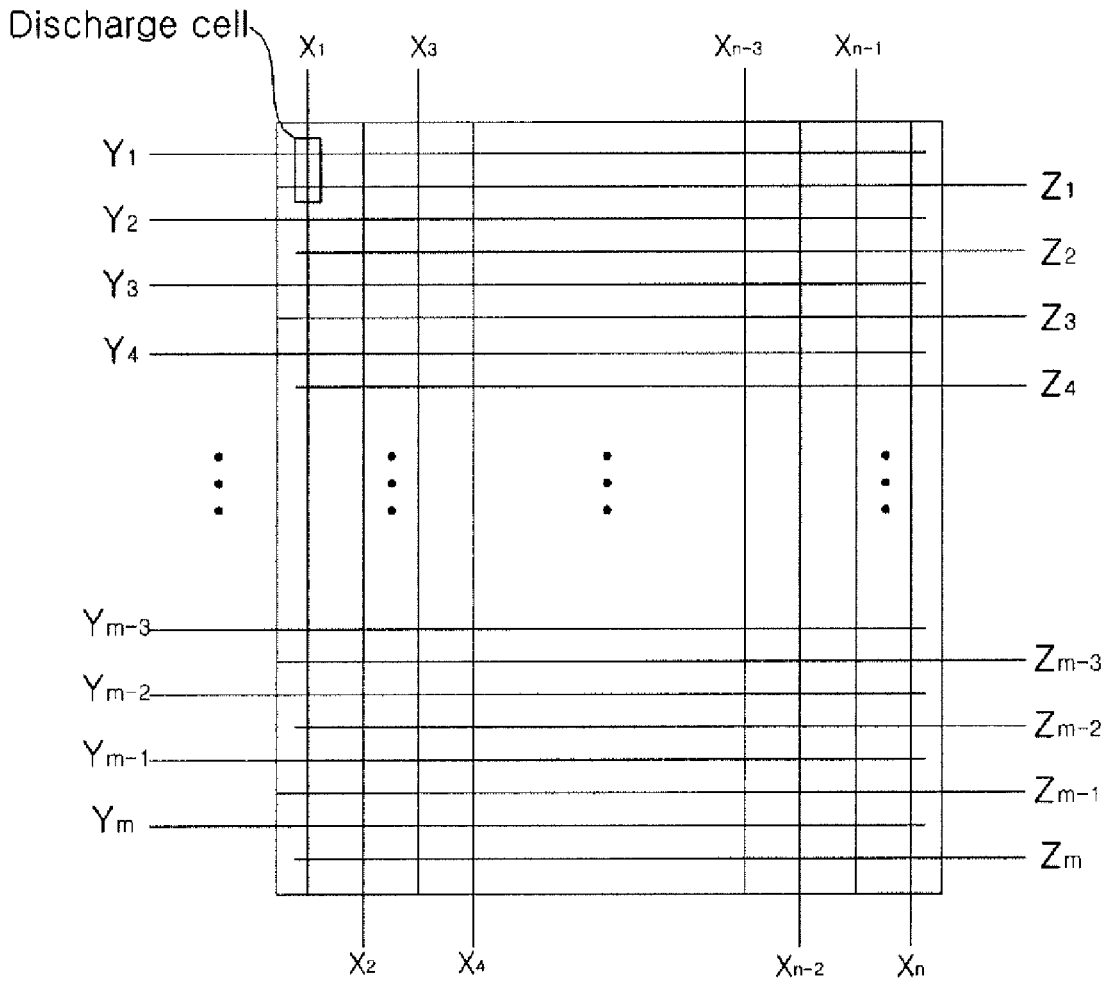
FIG. 2 is a sectional view illustrating the arrangement of the electrodes of the PDP according to an embodiment of the present invention.

FIG. 2 is a sectional view illustrating the arrangement of the electrodes of the PDP according to an embodiment of the present invention. The plurality of discharge cells that constitute the PDP, as illustrated in FIG. 2, are preferably arranged in a matrix. The plurality of discharge cells are provided in the intersections of scan electrode lines Y1 to Ym, sustain electrode lines Z1 to Zm, and address electrode lines X1 to Xn. The scan electrode lines Y1 to Ym can be sequentially or simultaneously driven and the sustain electrode lines Z1 to Zm can be simultaneously driven. The address electrode lines X1 to Xn can be divided into odd lines and even lines to be driven or can be sequentially driven.

Since the arrangement of the electrodes illustrated in FIG. 2 is only an embodiment of the arrangement of the electrodes of the PDP according to the present invention, the present invention is not limited to the arrangement of the electrodes of the PDP illustrated in FIG. 2 and the method of driving the PDP illustrated in FIG. 2. For example, a dual scan method in which two scan electrode lines among the scan electrode lines Y1 to Ym are simultaneously scanned can be performed. In addition, the address electrode lines X1 to Xn are divided into an upper part and a lower part in the center of the PDP to be driven.

Figure 3:
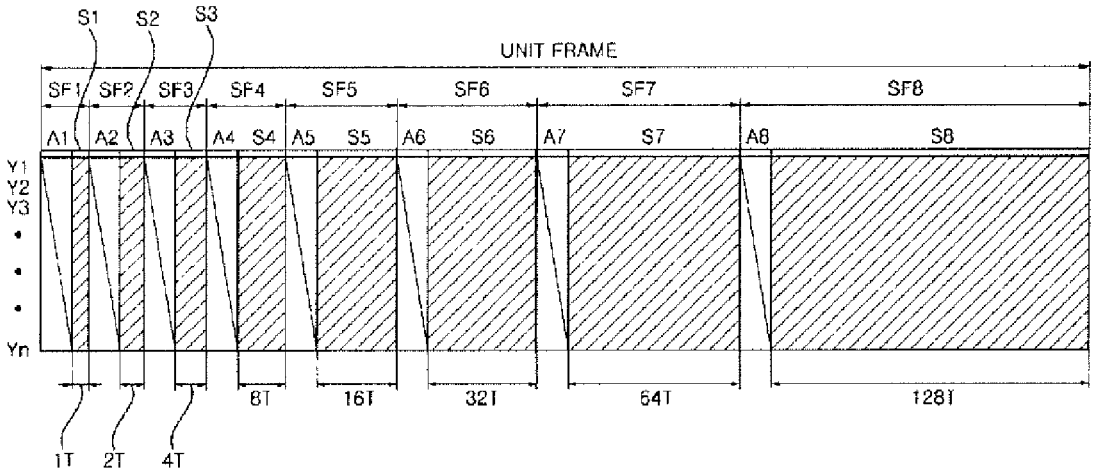
FIG. 3 is a timing diagram illustrating a method of dividing one frame into a plurality of subfields to time division drive the PDP according to an embodiment of the present invention.

FIG. 3 is a timing diagram illustrating a method of dividing one frame into a plurality of subfields to time division drive the PDP according to an embodiment of the present invention. A unit frame can be divided into a predetermined number of, for example, eight subfields SF1, . . . , and SF8 in order to display time division gray levels. In addition, each of the subfields SF1, . . . , and SF8 is divided into a reset period (not shown), address periods A1, . . . , and A8, and sustain periods S1, . . . , and S8.

Here, according to an embodiment of the present invention, the reset period can be omitted from at least one of the plurality of subfields. For example, the reset period can exist only in an initial subfield or only in an intermediate subfield among all of the subfields.

In the address periods A1, . . . , and A8, display data signals are applied to the address electrodes X and scan pulses corresponding to the scan electrodes Y are sequentially applied.

In the sustain periods S1, . . . , and S8, sustain pulses are alternately applied to the scan electrodes Y and the sustain electrodes Z to generate sustain discharge by the discharge cells where wall charges are formed in the address periods A1, . . . , and A8.

The brightness of the PDP is in proportion to the number of sustain discharge pulses in the sustain discharge periods S1, . . . , and S8 occupied in the unit frame. When one frame that forms an image is displayed into the eight subfields and 256 gray levels, different numbers of sustain pulses can be sequentially assigned to the subfields in the ratio of 1, 2, 4, 8, 16, 32, 64, and 128. In order to obtain the brightness of 133 gray levels, cells are addressed in a subfield 1 period, a subfield 3 period, and a subfield 8 period to perform the sustain discharge.

The number of sustain discharges assigned to the subfields can be variably determined in accordance with the weight value of the subfields in accordance with an automatic power control (APC) step. That is, in FIG. 3 one frame is divided into the eight subfields. However, the present invention is not limited thereto and the number of subfields that constitute one frame can vary in accordance with a design. For example, one frame can be divided into no less than the eight subfields such as 12 or 16 subfields to drive the PDP.

In addition, the number of sustain discharges assigned to the subfields can vary in consideration of a gamma characteristic or a panel characteristic. For example, the degree of gray levels assigned to the subfield 4 can be reduced from 8 to 6 and the degree of gray levels assigned to the subfield 6 can be increased from 32 to 34.

Figure 4:
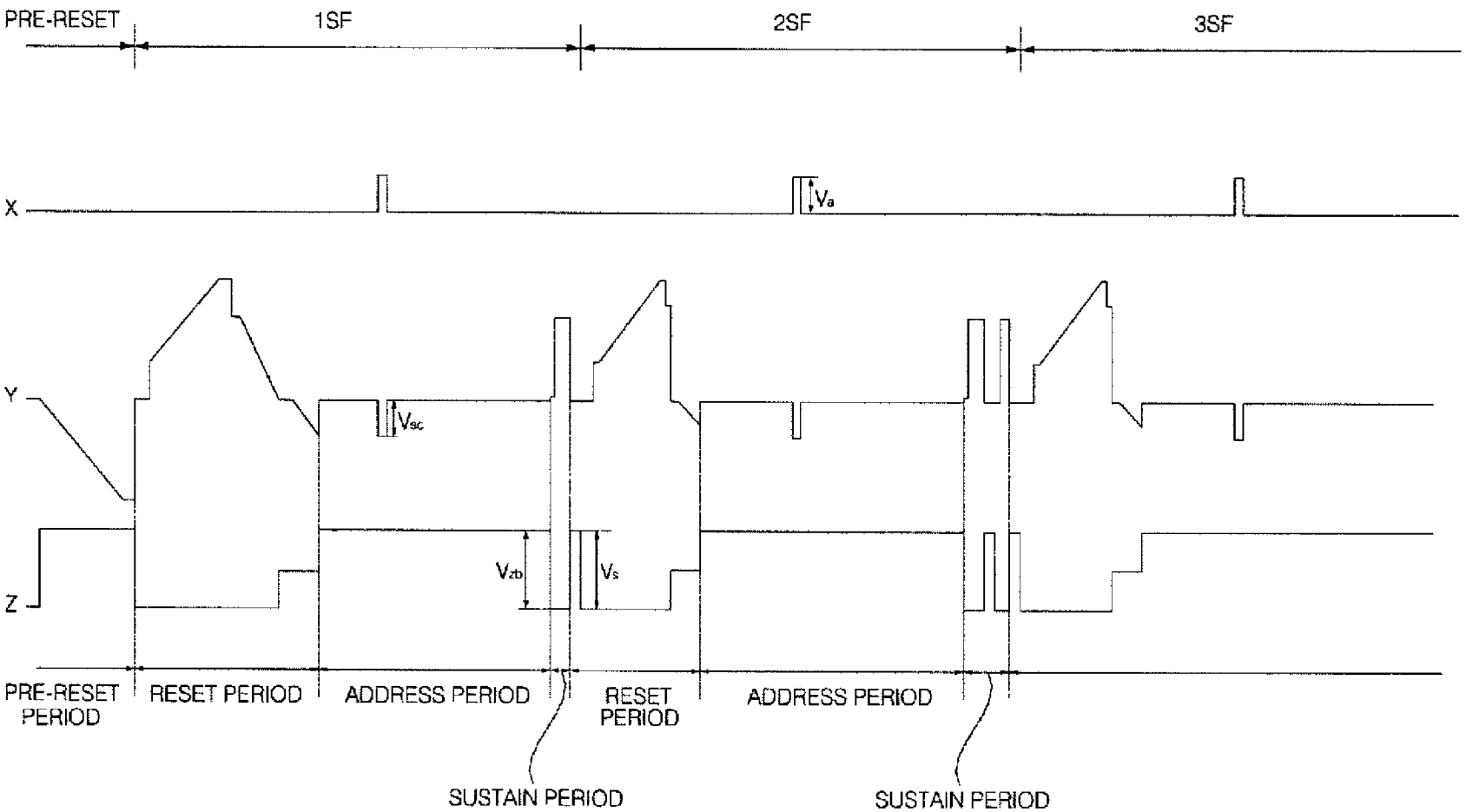
FIG. 4 is a timing diagram illustrating driving signals for driving the PDP according to an embodiment of the present invention.

FIG. 4 is a timing diagram illustrating driving signals for driving the PDP according to an embodiment of the present invention.

The subfield includes a pre-reset period for forming positive polar wall charges on the scan electrodes Y and for forming negative polar wall charges on the sustain electrodes Z, a reset period for initializing the discharge cells on the entire screen using the distribution of the wall charges formed in the pre-reset period, an address period for selecting discharge cells, and a sustain period for sustaining the discharge of the selected discharge cells.

The reset period is divided into a set up period and a set down period. In the set up period, a rising ramp waveform is simultaneously applied to all of the scan electrodes so that fine discharge is generated by all of the discharge cells and that the wall charges are generated. In the set down period, a falling ramp waveform Ramp-down that falls at a positive polar voltage lower than the peak voltage of the rising ramp waveform Ramp-up is simultaneously applied to all of the scan electrodes Y so that erase discharge is generated by all of the discharge cells and that unnecessary charges are erased among the wall charges and space charges generated by set up discharge.

In the address period, negative polar scan signals scan are sequentially applied to the scan electrodes and, at the same time, data signals data having a positive polar voltage Va are applied to the address electrodes X. Address discharge is generated by a voltage difference between the scan signals scan and the data signals data and a wall voltage generated in the reset period to select cells. On the other hand, signals that sustain a sustain voltage are applied to the sustain electrodes in the set down period and the address period.

In the sustain period, the sustain pulses having the sustain voltage Vs are alternately applied to the scan electrodes and the sustain electrodes to generate the sustain discharge in the form of surface discharge between the scan electrodes and the sustain electrodes.

The driving waveforms illustrated in FIG. 4 are only an embodiment of signals for driving the PDP according to the present invention. The present invention is not limited to the waveforms illustrated in FIG. 4. For example, the pre-reset period can be omitted, the polarity and the voltage level of the driving signals illustrated in FIG. 4 can vary if necessary, and erase signals for erasing the wall charges after the sustain discharge is completed can be applied to the sustain electrodes. In addition, single sustain driving in which the sustain signals can be applied to one of the scan electrodes Y and the sustain electrodes Z so that the sustain discharge is generated can be performed.

Figure 5:
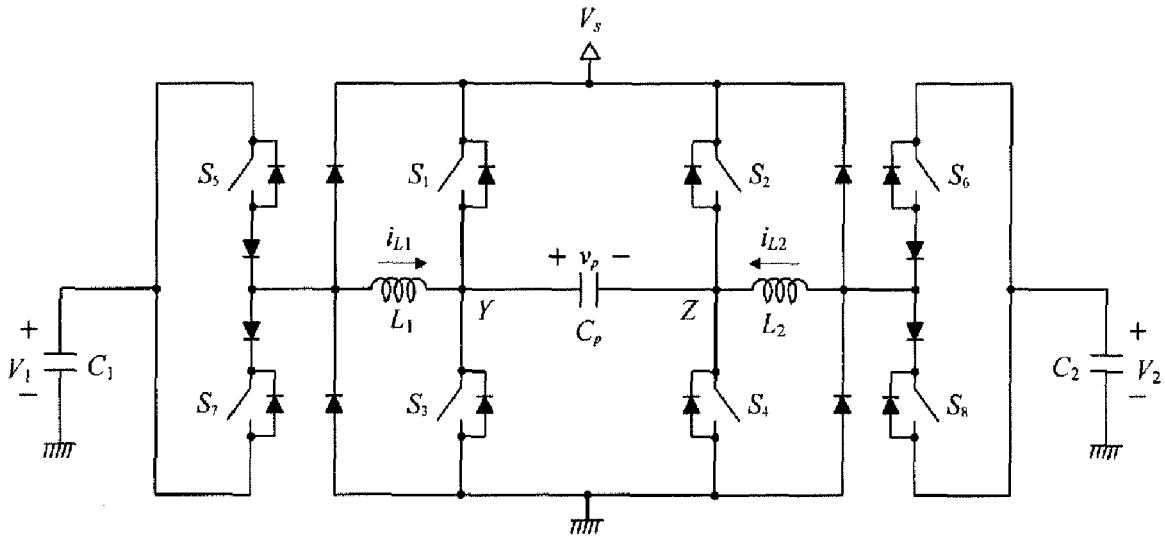
FIG. 5 is a circuit diagram illustrating the structure of an energy recovery circuit for supplying the driving signals to the scan electrodes or the sustain electrodes of the PDP.

FIG. 5 is a circuit diagram illustrating the structure of an energy recovery circuit for supplying the sustain signals to the scan electrodes and the sustain electrodes of the PDP.

Referring to FIG. 5, the energy recovery circuit can include source capacitors $C_1$ and $C_2$, inductors $L_1$ and $L_2$, sus up switches $S_1$ and $S_2$, sus down switches $S_3$ and $S_4$, energy supply switches $S_5$ and $S_6$, and energy recovery switches $S_7$ and $S_8$.

The source capacitors $C_1$ and $C_2$ recover energy from a panel capacitor Cp to store the recovered energy. The inductors $L_1$ and $L_2$ forms a resonance circuit together with the panel capacitor Cp and the source capacitors $C_1$ and $C_2$. The energy supply/recovery switches $S_5$, $S_6$, $S_7$, and $S_8$ are connected between the source capacitors $C_1$ and $C_2$ and the inductors $L_1$ and $L_2$ to control the supply and recovery of energy. The source capacitors $C_1$ and $C_2$ recover the voltage charged in the PDP during the sustain discharge to store the recovered voltage and re-supply the stored voltage to the PDP when the sustain signals are supplied to the PDP.

The panel capacitor Cp equivalently illustrates constant capacity formed between the scan electrodes Y and the sustain electrodes Z.

The sus up switches $S_1$ and $S_2$ are connected to the sustain voltage source Vs to be turned on in order to supply the sustain voltage to the PDP. The sus down switches $S_3$ and $S_4$ are connected to a reference voltage source to be turned on in order to reduce the voltage of the PDP to a reference voltage. As illustrated in FIG. 5, the reference voltage can be a ground voltage GND and the reference voltage source to which the sus down switches $S_3$ and $S_4$ are connected can be ground.

Figure 6:
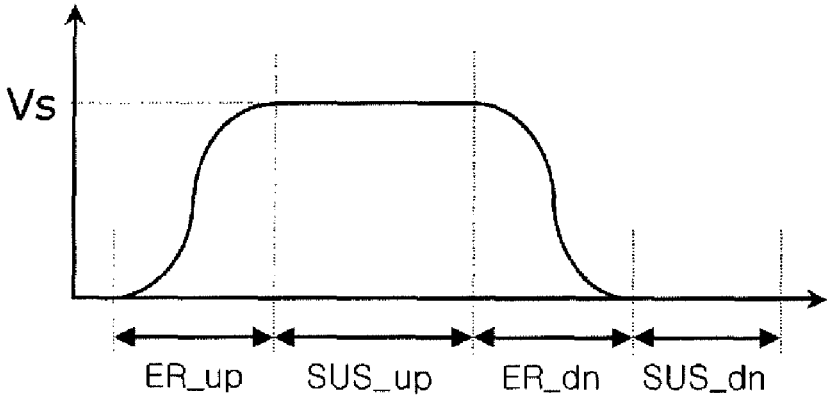
FIGS. 6 and 7 are timing diagrams for illustrating the operation of the energy recovery circuit illustrated in FIG. 5.

The operation of the energy recovery circuit will be described in detail with reference to an embodiment of the waveform of the sustain signal illustrated in FIG. 6.

Hereinafter, the case in which the sustain signal is supplied to the scan electrodes Y will be described as an example.

When the power source of the entire plasma display device is turned on so that a plurality of discharges are continuously generated by the PDP, the discharge current of the PDP is charged in the source capacitor $C_1$ through the inductor $L_1$.

When the energy supply switch $S_5$ is turned on in an energy supply period ER_up, the voltage charged in the source capacitor $C_1$ is supplied to the scan electrodes Y so that the voltage of the sustain signals supplied to the scan electrodes Y gradually increases.

Then, when the sus up switch $S_1$ is turned on in a sustain voltage sustain period SUS_up, the sustain signals supplied to the scan electrodes Y sustain the sustain voltage Vs.

When the energy recovery switch $S_7$ is turned on in an energy recovery period ER_dn, the energy charged in the scan electrodes Y is recovered to the source capacitor $C_1$ through the inductor $L_1$ to be charged. Therefore, the voltage of the sustain signals supplied to the scan electrodes Y is gradually reduced.

Then, when the sus down switch $S_3$ is turned on in a reference voltage sustain period SUS_dn, the voltage of the sustain signals supplied to the scan electrodes Y is rapidly reduced to the reference voltage, for example, a ground voltage to be sustained.

That is, in the energy supply period ER_up and the energy recovery period ER_dn, a resonance circuit formed of the source capacitor $C_1$, the panel capacitance Cp, and the inductor $L_1$ is provided so that the energy charged in the source capacitor $C_1$ by the resonance is supplied to the scan electrodes Y through the inductor $L_1$ or the energy charged in the scan electrodes Y is recovered to the source capacitor $C_1$.

While repeating the energy supply period ER_up and the reference voltage sustain period SUS_dn, the energy recovery circuit supplies the sustain signals to the scan electrodes Y.

In addition, the sustain signals can be supplied to the sustain electrodes Z by the operation described with reference to FIG. 6. Therefore, as illustrated in FIG. 5, an energy recovery circuit for supplying the sustain signals to the scan electrodes Y is symmetrical with an energy recovery circuit for supplying the sustain signals to the sustain electrodes Z.

Hereinafter, referring to FIG. 7, the operation of the energy recovery circuit illustrated in FIG. 5 will be described in detail.

Figure 7:
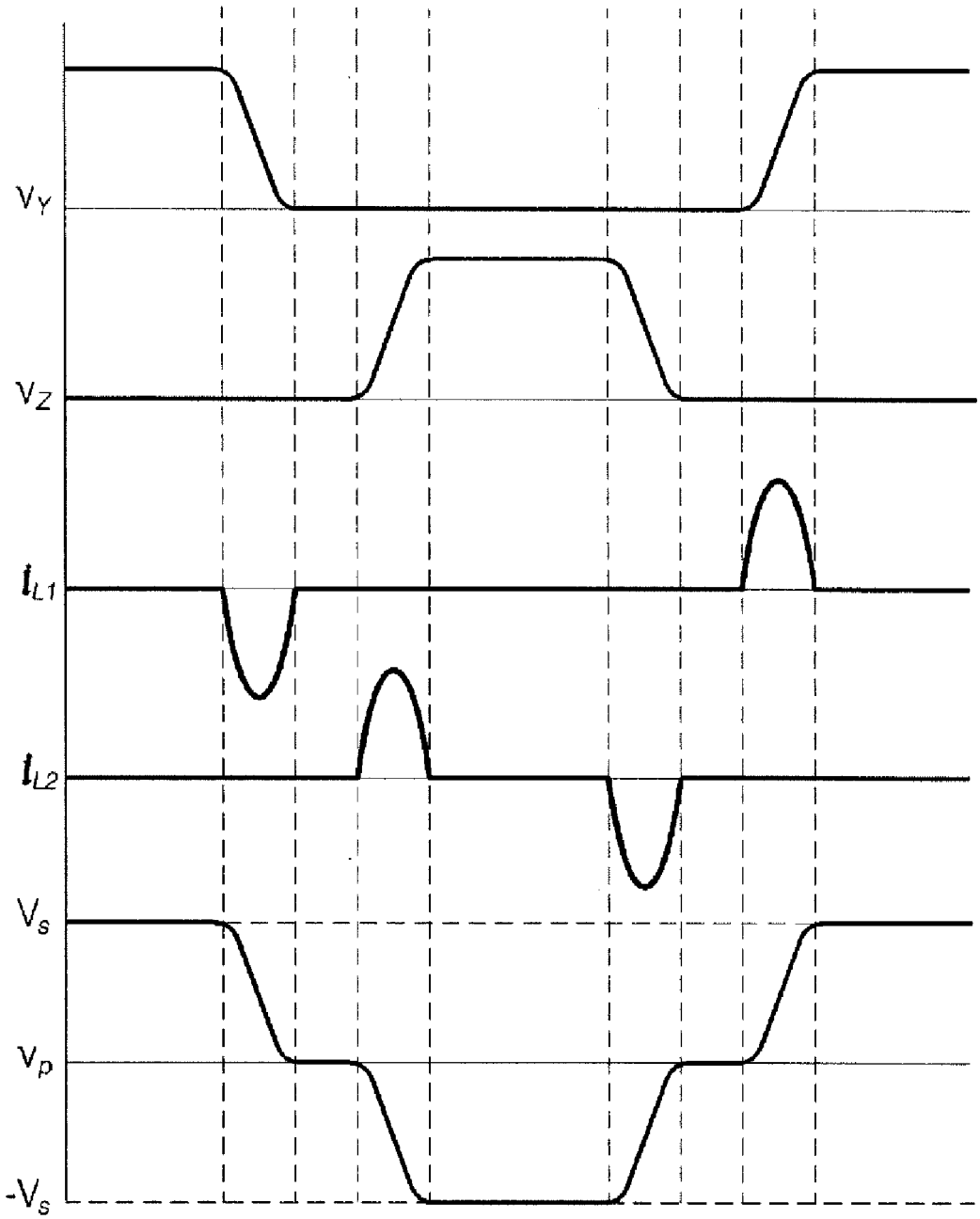

As illustrated in FIG. 7, resonance is generated only in a period where energy is charged and discharged from the source capacitors $C_1$ and $C_2$ to the PDP, that is, only in the energy supply/recovery periods ER_up and ER_dn of the sustain signals supplied to the scan electrodes Y and the sustain electrodes Z so that currents $i_{L1}$ and $i_{L2}$ that flow through the inductors $L_1$ and $L_2$ can change.

As described above, in order for the voltage of the sustain signals to be increased to the sustain voltage or to be reduced to the reference voltage by the resonance generated only in the energy supply/recovery periods ER_up and ER_dn, the energy supply/recovery periods ER_up and ER_dn must be long enough. In such a case, the sustain voltage sustain period SUS_up is relatively short so that the sustain discharge efficiency of the PDP can be reduced and that the sustain discharge can be delayed.

In the case of a high resolution PDP, as the number of scan electrode lines and sustain electrode lines increases, it is difficult to secure the driving margin of the PDP and power consumption for driving the PDP can increase.

That is, since driving time that can be assigned to the subfields that constitute one frame is limited to a uniform range, in the case of the high resolution PDP, the width of the scan signals supplied to the scan electrodes in the address period or the width of the sustain signals supplied in the sustain period must be reduced.

For example, in the case of the high resolution PDP no less than a full HD level, the number of scan electrode lines and the number of sustain electrode lines are no less than 1,080, respectively. In order to secure the driving margin of the PDP, when the number of scan electrode lines and the length of the address period are considered, the width of the scan signals can be no more than 1.5 μm.

In addition, as described above, in the case of the high resolution PDP, in order to secure the driving margin for driving the PDP at high speed, the width of the sustain signals can be reduced.

In the plasma display device according to the present invention, in order to prevent the efficiency of the sustain discharge from being reduced and to prevent the sustain discharge from being delayed due to the reduction in the width of the sustain signals, the length of the energy supply period ER_up or the energy recovery period ER_dn of the sustain signals is preferably reduced.

Figure 8:
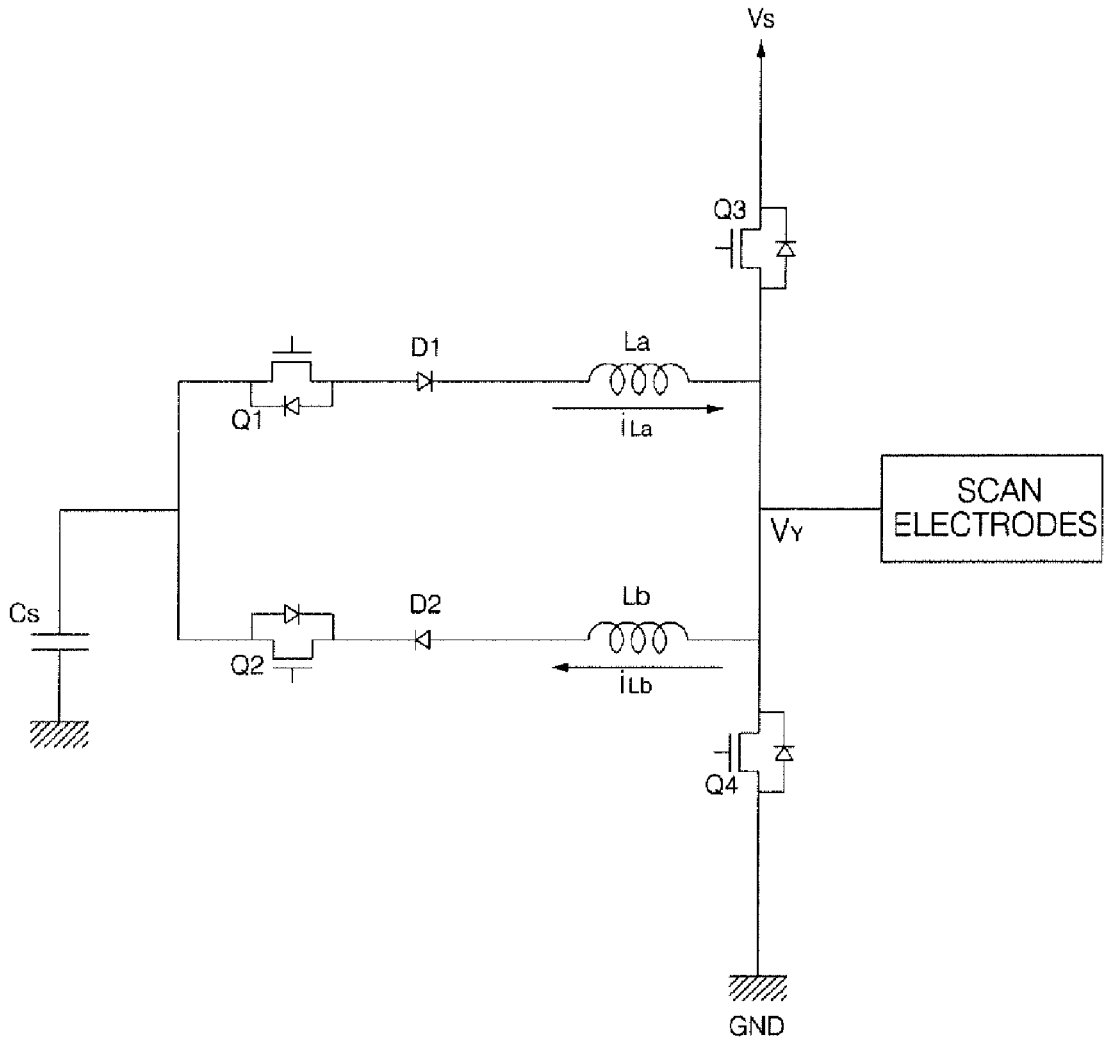
FIG. 8 is a circuit diagram illustrating the structure of the energy recovery circuit according to an embodiment of the present invention.

FIG. 8 is a circuit diagram illustrating the structure of the energy recovery circuit for supplying the sustain signals to the scan electrodes Y according to an embodiment of the present invention. In the operation of the energy recovery circuit illustrated in FIG. 8, description of the same one as described with reference to FIGS. 5 to 7 will be omitted.

Referring to FIG. 8, the energy recovery circuit according to the present invention can include a first inductor La connected to an energy supply switch Q1 to form a resonance circuit together with a source capacitor Cs when energy is supplied from the source capacitor Cs to the scan electrodes and a second inductor Lb connected to an energy recovery switch Q2 to form a resonance circuit together with the source capacitor Cs when energy is recovered from the scan electrodes to the source capacitor Cs.

The operation of the energy recovery circuit illustrated in FIG. 8 will be described in detail with reference to FIG. 9.

Figure 9:
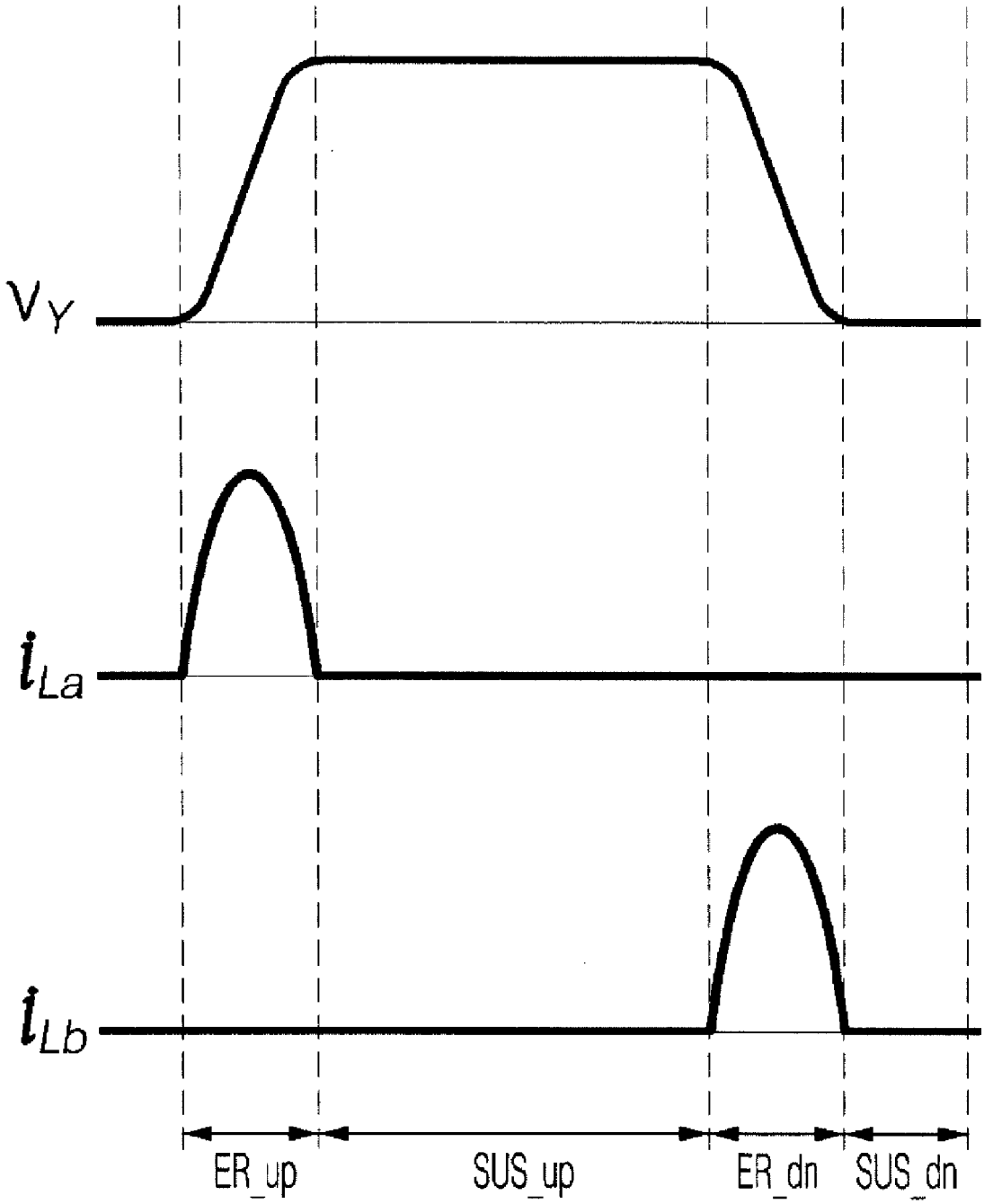
FIG. 9 is a timing diagram illustrating the waveform of a sustain signal supplied from the energy recovery circuit illustrated in FIG. 8 and inductor currents.

As illustrated in FIG. 9, in the energy supply period ER_up of the sustain signals, the energy supply switch Q1 is turned on so that the source capacitor Cs and the first inductor La constitute the resonance circuit. Therefore, the current $i_{La}$ that flows through the first inductor La is gradually increased from a minimum value to a maximum value and then, is gradually reduced to the minimum value so that the voltage Vy supplied to the scan electrodes is gradually increased.

In addition, in the energy recovery period ER_dn of the sustain signals, the energy recovery switch Q2 is turned on so that the source capacitor Cs and the second inductor Lb constitute the resonance circuit. Therefore, the current $i_{Lb}$ that flows through the second inductor Lb is gradually increased from a minimum value to a maximum value and then, is gradually reduced to the minimum value so that the voltage Vy supplied to the scan electrodes is gradually reduced.

In the case of the plasma display device according to the present invention, before the current $i_{La}$ that flows through the first inductor La is reduced to the minimum value in order to secure the driving margin of the high resolution PDP, a sus up switch Q3 is turned on so that the sustain voltage Vs can be supplied to the scan electrodes. In addition, before the current $i_{Lb}$ that flows through the second inductor Lb is reduced to the minimum value, a sus down switch Q4 is turned on so that a reference voltage GND can be supplied to the scan electrodes. Therefore, it is possible to secure the driving margin of the PDP, to sustain the length of the sustain voltage sustain period SUS_up enough to stably generate the sustain discharge, and to reduce the delay of the sustain discharge.

FIGS. 10 to 13 are timing diagrams illustrating the waveform of the sustain signal and the inductor currents according to an embodiment of the present invention.

Figure 10:
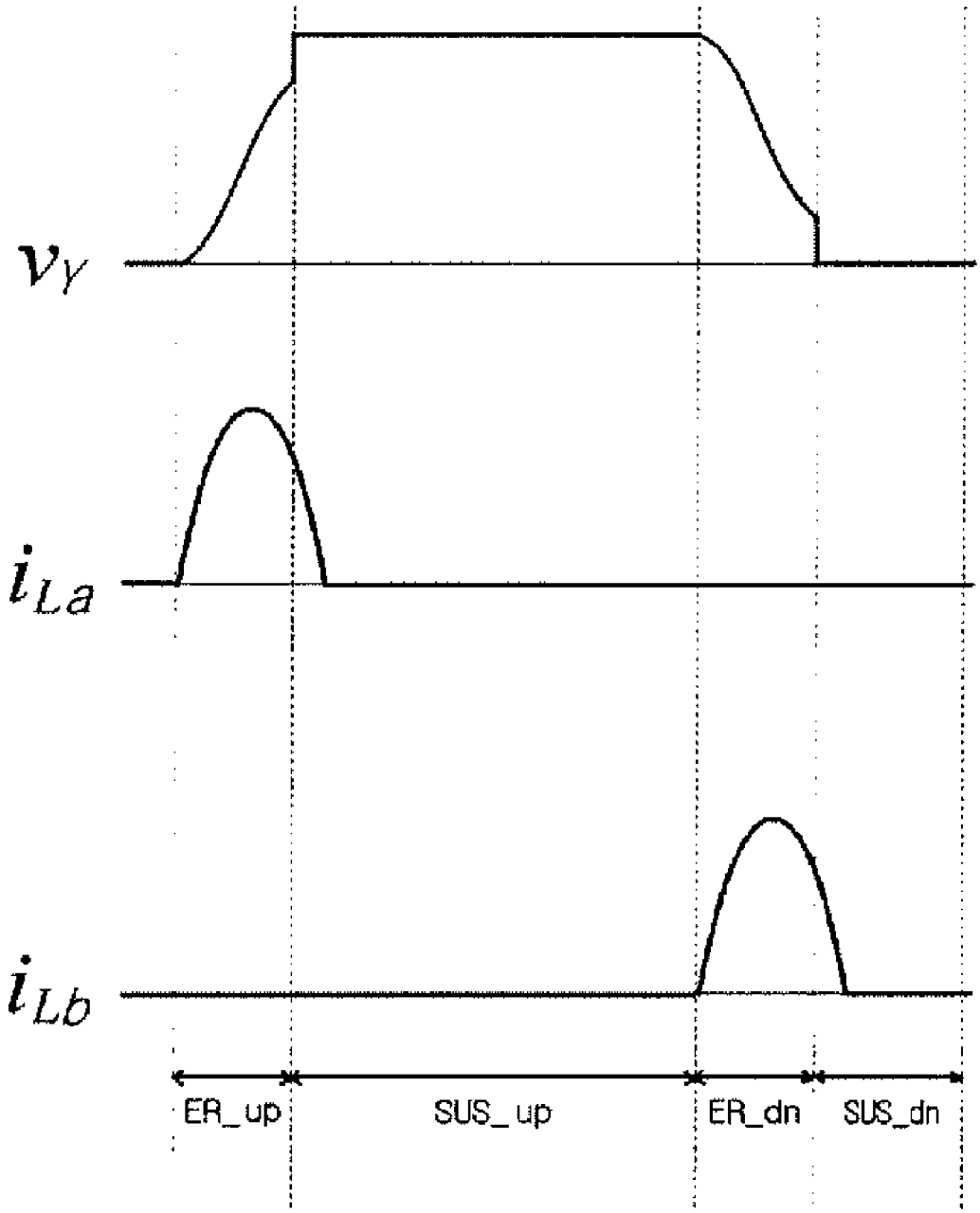
FIGS. 10 to 13 are timing diagrams illustrating the waveform of the sustain signal and the inductor currents according to an embodiment of the present invention.

Referring to FIG. 10, in the energy supply period ER_up of the sustain signals, the sus up switch Q3 is turned on before the current $i_{La}$ that flows through the first inductor La is increased to the maximum value and then, is reduced to the minimum value so that the voltage Vy supplied to the scan electrodes can be rapidly increased to the sustain voltage Vs.

In addition, in the energy recovery period ER_dn of the sustain signals, the sus down switch Q4 is turned on before the current $i_{Lb}$ that flows through the second inductor Lb is increased to the maximum value and then, is reduced to the minimum value so that the voltage Vy supplied to the scan electrodes can be rapidly reduced to the reference voltage Vs.

Figure 11:
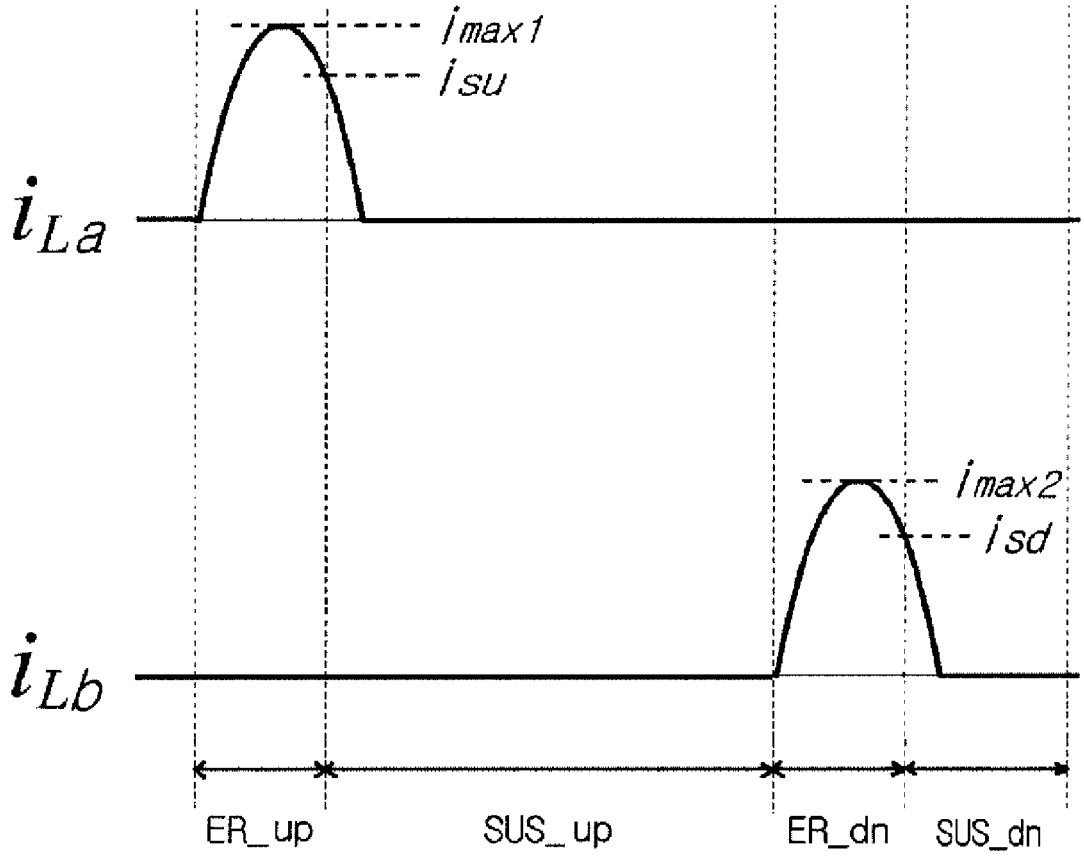

Referring to FIG. 11, the sus up switch Q3 is turned on at the point of time where the current $i_{La}$ that flows through the first inductor La has a value $i_{su}$ smaller than a maximum value $i_{max1}$ and larger than a minimum value 0 so that the sustain voltage Vs can be supplied to the scan electrodes.

TABLE 1 represents the results of measuring a change in panel driving power consumption in accordance with the first inductor current $i_{su}$ at the point of time where the sustain voltage sustain period SUS_up starts based on the current consumed in the case where $i_{su}/i_{max1}$ are 0, that is, where the sustain voltage sustain period SUS_up starts at the point of time where the current $i_{La}$ that flows through the first inductor La is reduced from the maximum value $i_{max1}$ to the minimum value 0.

TABLE 1

| $i_{su}/i_{max1}$ | Power consumption |
|---|---|
| 0 | 1 |
| 0.05 | 1 |
| 0.1 | 1.01 |
| 0.15 | 1.01 |
| 0.2 | 1.01 |
| 0.25 | 1.02 |
| 0.3 | 1.02 |
| 0.35 | 1.02 |
| 0.4 | 1.02 |
| 0.45 | 1.02 |
| 0.5 | 1.02 |
| 0.55 | 1.03 |
| 0.6 | 1.04 |
| 0.65 | 1.04 |
| 0.7 | 1.11 |
| 0.75 | 1.13 |
| 0.8 | 1.13 |
| 0.85 | 1.14 |
| 0.9 | 1.2 |
| 0.95 | 1.22 |
| 1 | 1.23 |

Figure 14:
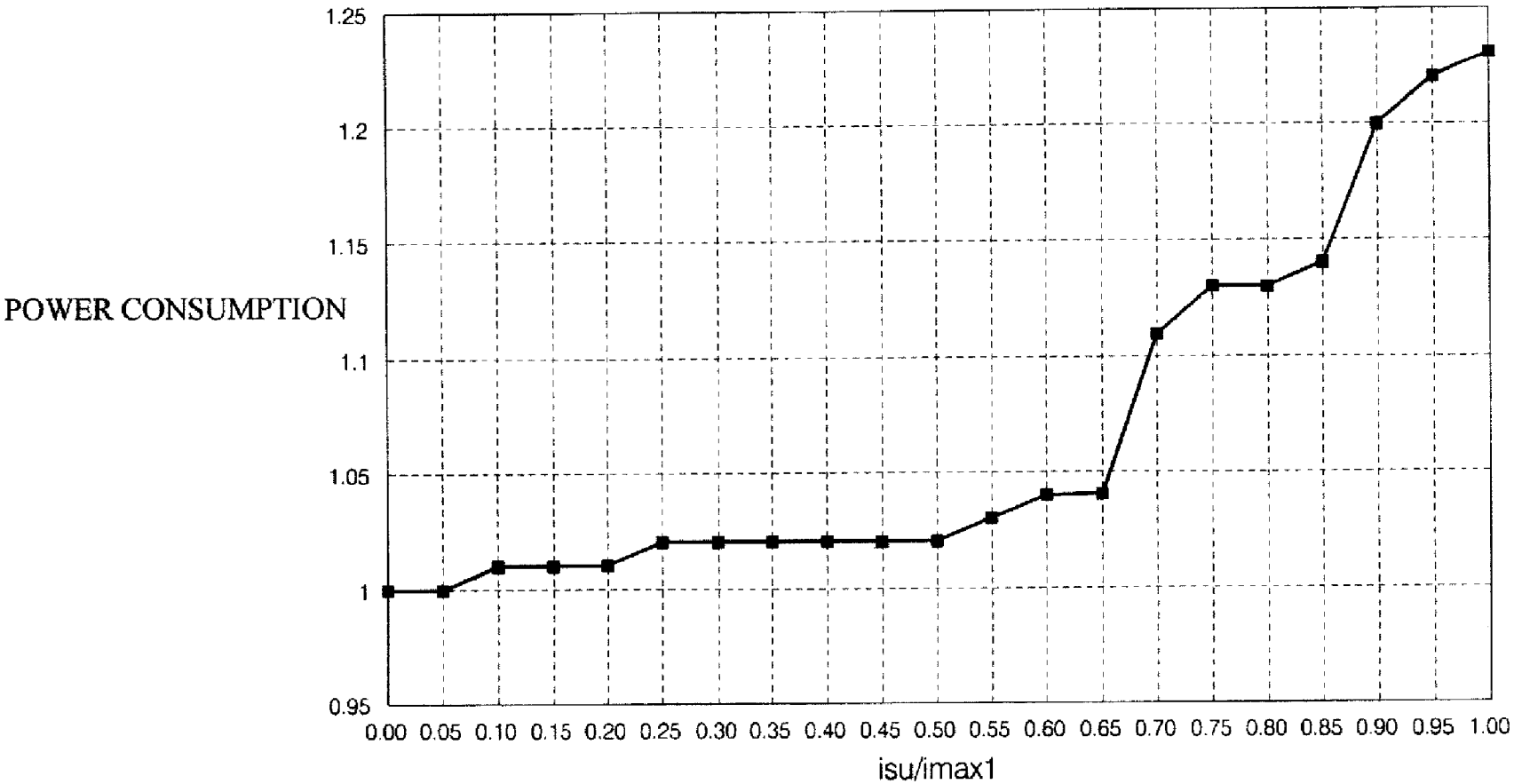
FIGS. 14 and 15 are graphs illustrating the results of measuring the amount of power consumption of the energy recovery circuit according to the present invention.

FIG. 14 is a graph illustrating the measurement results represented in TABLE 1.

Referring to TABLE 1 and FIG. 14, it is noted that power consumption increases as $i_{su}/i_{max1}$ increases from 0.

To be specific, as $i_{su}/i_{max1}$ is increased to a value close to 1, the supply of energy using resonance is not performed enough so that power consumption increases and that switching loss at the point of time where the sustain voltage sustain period SUS_up starts can increase.

Therefore, when the $i_{su}/i_{max1}$ is increased to be larger than 0.85, power consumption is rapidly increased no less than 1.2 times in comparison with the case where the $i_{su}/i_{max1}$ is 0.

In addition, as described above, in the high-resolution PDP no less than the FULL HD level, the length of the energy supply period ER_up is preferably reduced in order to secure the driving margin. When the width of the sustain signals for securing the driving margin and the prevention of the delay of the sustain discharge are considered, the $i_{su}/i_{max1}$ is preferably no less than 0.5.

Therefore, in order not to remarkably increase power consumption for driving the PDP and to secure of the driving margin of the high-resolution PDP and to prevent the delay of the sustain discharge, the $i_{su}/i_{max1}$ is preferably 0.5 to 0.85.

When the $i_{su}/i_{max1}$ is reduced to less than 0.85, power consumption caused by the switching loss is reduced. When the $i_{su}/i_{max1}$ is no more than 0.65, it is noted that the power consumption is rapidly reduced no more than 1.05 times in comparison with the case in which the $i_{su}/i_{max1}$ is 0.

Therefore, in order to prevent the increase in the power consumption that is caused by the switching loss of the energy recovery circuit, the $i_{su}/i_{max1}$ can be no more than 0.65.

Referring to FIG. 11, it is noted that the point of time at which the reference voltage sustain period SUS_dn starts is the point of time at which the current $i_{Lb}$ that flows through the second inductor Lb has a value $i_{sd}$ smaller than a maximum value $i_{max2}$ and larger than the minimum value 0.

TABLE 2 represents the results of measuring a change in panel driving power consumption in accordance with the second inductor current $i_{sd}$ at the point of time where the reference voltage sustain period SUS_dn starts.

TABLE 2

| $i_{sd}/i_{max2}$ | Power consumption |
|---|---|
| 0 | 1 |
| 0.05 | 1 |
| 0.1 | 1.01 |
| 0.15 | 1.01 |
| 0.2 | 1.01 |
| 0.25 | 1.02 |
| 0.3 | 1.02 |
| 0.35 | 1.02 |
| 0.4 | 1.02 |
| 0.45 | 1.02 |
| 0.5 | 1.02 |
| 0.55 | 1.03 |
| 0.6 | 1.03 |
| 0.65 | 1.05 |
| 0.7 | 1.06 |
| 0.75 | 1.06 |
| 0.8 | 1.13 |
| 0.85 | 1.15 |
| 0.9 | 1.15 |
| 0.95 | 1.21 |
| 1 | 1.23 |

Figure 15:
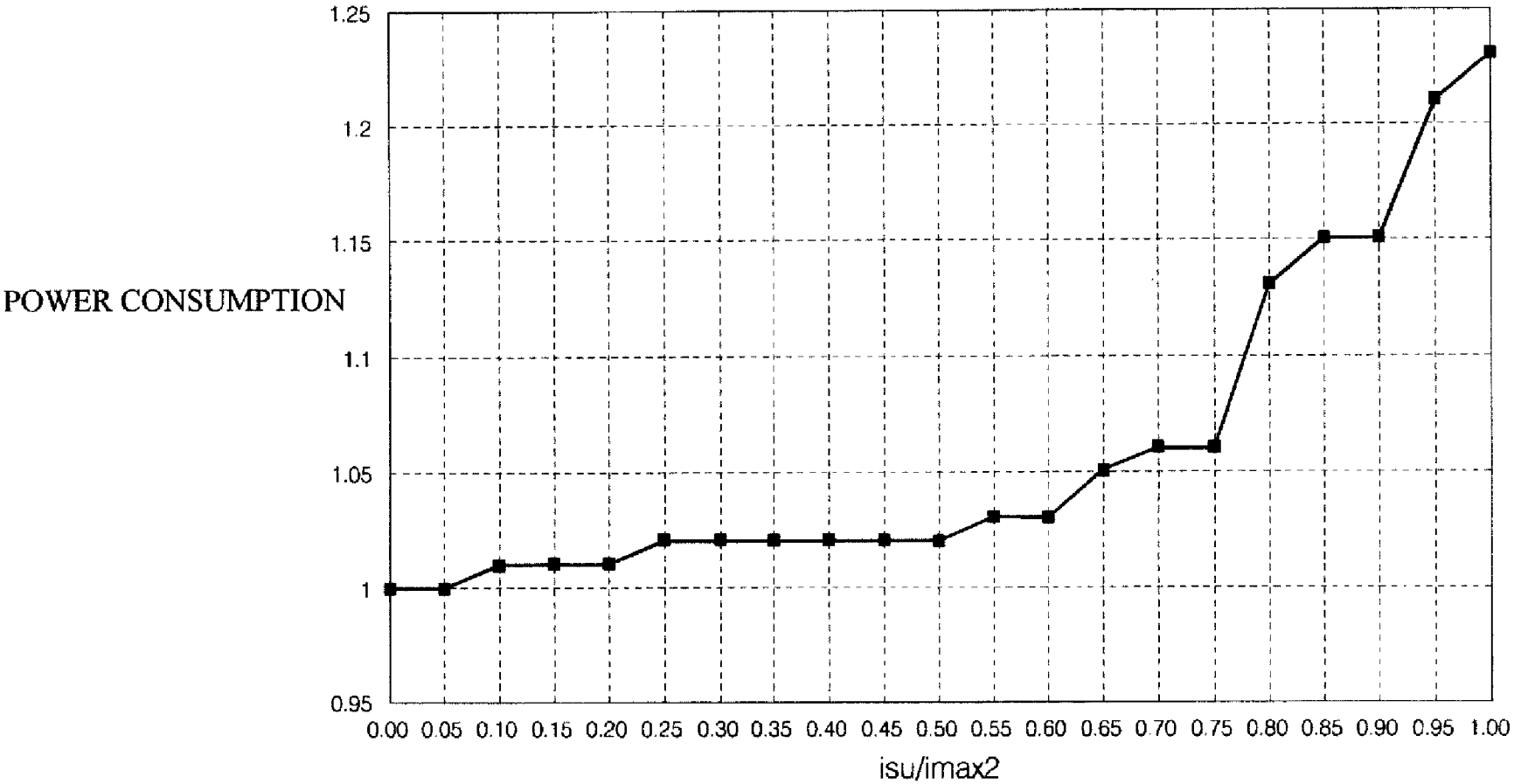

FIG. 15 is a graph illustrating the results of measuring power consumption represented in TABLE 2.

Referring to TABLE 2 and FIG. 15, it is noted that, when the $i_{sd}/i_{max2}$ is increased to be larger than 0.9, power consumption is rapidly increased no less than 1.2 times in comparison with the case where the $i_{sd}/i_{max2}$ is 0.

Therefore, in order to secure the driving margin of the high resolution PDP and to prevent the delay of the sustain discharge without remarkably increasing the power consumption for driving the PDP, the $i_{sd}/i_{max2}$ is preferably 0.5 to 0.90.

In addition, in order to prevent the increase in the power consumption that is caused by the switching loss of the energy recovery circuit to reduce the power consumption for driving the PDP, the $i_{sd}/i_{max2}$ can be no more than 0.75.

Figure 12:
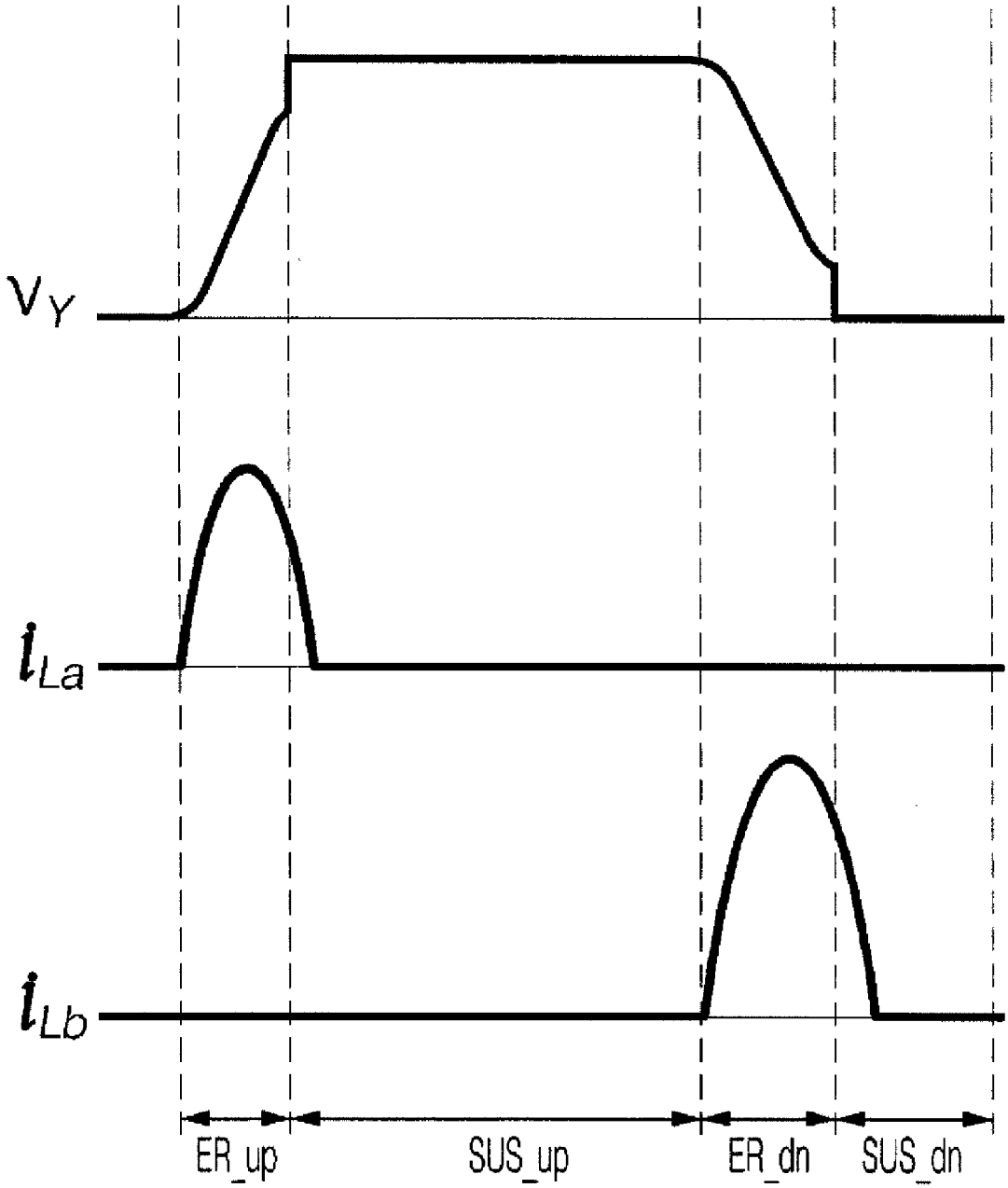
Figure 13:
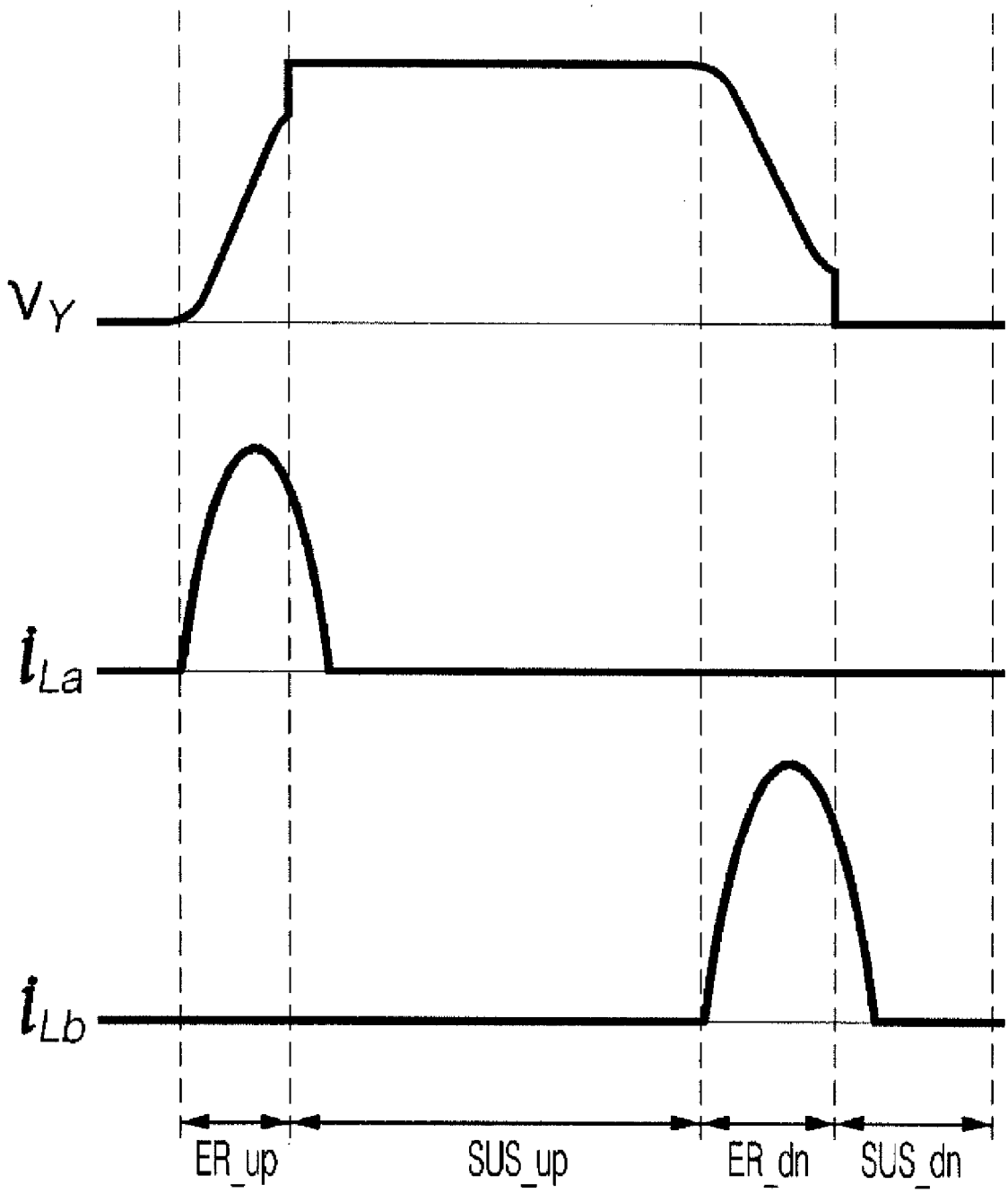

FIGS. 12 and 13 are timing diagrams illustrating the waveform of the sustain signal and the inductor current according to other embodiments of the present invention.

Referring to FIG. 12, the length of the energy supply period ER_up of the sustain signal can be shorter than the length of the energy recovery period ER_dn of the sustain signal so that it is possible to reduce the width of the sustain signal and to secure the driving margin of the PDP.

When the length of the sustain voltage sustain period SUS_up is reduced in the width of the sustain signal, the sustain discharge can become unstable and the amount of the wall charges formed by the sustain discharge is reduced so that the sustain discharge or the reset discharge in the next subfield can become unstable. In addition, when the length of the energy recovery period ER_dn is reduced, energy is not recovered enough from the PDP so that energy recovery efficiency is reduced and that the power consumption for driving the PDP can increase.

As illustrated in FIG. 12, when the length of the energy supply period ER_up is reduced, the sustain discharge can be stably and strongly generated. When the length of the energy supply period ER_up is remarkably reduced, the energy recovered from the PDP may not be used enough for supplying the sustain signal. When the length of the energy supply period ER_up remarkably increases, the driving margin of the PDP may not be secured enough.

Therefore, in order to secure the driving margin of the PDP and to stabilize the sustain discharge without remarkably reducing the energy recovery efficiency, the length of the energy supply period ER_up is preferably 0.21 times to 0.48 times the length of the energy recovery period ER_dn.

In order to make the length of the energy supply period ER_up shorter than the length of the energy recovery period ER_dn, as illustrated in FIG. 12, the size of a rising slope in the energy supply period ER_up can be increased to be larger than the size of a falling slope in the energy recovery period ER_dn.

Otherwise, as illustrated in FIG. 13, in the state where the sizes of the slopes in the energy supply period ER_up and the energy recovery period ER_dn are sustained to be equal to each other, the point of time at which the sustain voltage sustain period SUS_up switch is turned on, that is, the point of time at which the sustain voltage sustain period SUS_up starts is advanced so that the length of the energy supply period ER_up can be made shorter than the length of the energy recovery period ER_dn.

In the case of the high resolution PDP, as the number of scan electrode lines increase, the length of the address period can increase. For example, in the case of the high resolution PDP no less than the full HD level, the number of scan electrode lines increases to be no less than 1,080 so that the length of the address period for supplying the scan signals to the plurality of scan electrodes no less than the 1,080 lines can increase.

Therefore, it is possible to reduce the width of the sustain signals using the above described method of supplying the sustain signals according to the present invention. As a result, the length of the sustain period is reduced to secure the driving margin for increasing the length of the address period.

Since the length of the sustain period that can be reduced by the method of supplying the sustain signal according to the present invention is limited, the length of the address period cannot be increased to be no less than a predetermined value in order to secure the driving margin of the PDP. Therefore, the width of the scan signals sequentially supplied to the scan electrode lines is to be reduced. As a result, the possibility of generating address erroneous discharge can increase.

For example, in the case of the full HD PDP, since the number of scan electrode lines is no less than 1,080, when it is assumed than one frame is about 16.67 ms, in order to secure the driving margin of the PDP, the width of the scan signals must be no more than 1.5μ. When the width of the scan signals is reduced, a jitter characteristic deteriorates so that discharge delay in the address period can increase.

TABLE 3 represents the results of measuring whether the address erroneous discharge is generated in accordance with a change in the width of the scan signals.

TABLE 3

| Width of scan pulses | Whether address erroneous discharge is generated |
|---|---|
| 1.10 μs | X |
| 1.05 μs | X |
| 1.00 μs | X |
| 0.95 μs | X |
| 0.90 μs | X |
| 0.85 μs | X |
| 0.80 μs | X |
| 0.75 μs | X |
| 0.70 μs | X |
| 0.65 μs | ○ |
| 0.60 μs | ○ |
| 0.55 μs | ○ |

Referring to TABLE 3, when the width of the scan signals is reduced to be less than 0.7 μs, due to the deterioration of the jitter characteristic, the discharge delay is remarkably generated so that the address erroneous discharge is generated.

Therefore, in the plasma display device according to the present invention, in order to secure the driving margin of the PDP and to prevent the address erroneous discharge in the high resolution PDP such as the full HD PDP, the width of the scan signals is preferably 0.7 μs to 0.11 μs.

In the above, the energy recovery circuit according to the present invention is used for the plasma display device. However, the present invention is not limited to the above but can be used for generating the driving signals supplied to various display panels such as a liquid crystal display (LCD) and an organic light emitting diode (OLED) other than the PDP.

According to the present invention having the above-described structure, in supplying the sustain signals to the PDP, the point of time where the sustain voltage sustain period or the reference voltage sustain period starts is controlled so that the driving margin of the PDP can be secured enough without remarkably increasing the power consumption for the PDP and that the high resolution PDP can be driven at high speed.

Although embodiments of the present invention have been described with reference to drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. A plasma display device comprising a plasma display panel (PDP) and a driving unit for generating driving signals for driving the PDP, wherein the driving unit comprises an energy recovery circuit comprising at least one inductor, a first switch, and a second switch, wherein a period in which sustain signals are supplied to the PDP comprises a first period in which energy is supplied from the inductor to the PDP and the first switch is turned off, a second period in which the first switch is turned on so that a sustain voltage is supplied to the PDP, a third period in which energy is recovered from the PDP to the inductor and the second switch is turned off, and a fourth period in which the second switch is turned on to supply the reference voltage to the PDP, wherein a length of the first period is shorter than a length of the third period, and wherein the first switch is turned on at a point of time before a magnitude of current that flows through the inductor reaches a maximum value and then, becomes 0 in the first period.

2. The plasma display device of claim 1, wherein the length of the first period is 0.21 times to 0.48 times the length of the third period.

3. The plasma display device of claim 1, wherein the magnitude of current that flows through the inductor for supplying energy to the PDP at the point of time where the first switch is turned on is 0.5 times to 0.85 times the maximum value.

4. The plasma display device of claim 1, wherein the magnitude of the current that flows through the inductor for supplying energy to the PDP at the point of time where the first switch is turned on is 0.5 times to 0.65 times the maximum value.

5. The plasma display device of claim 1, wherein the second switch is turned on at a point of time before a magnitude of current that flows through the inductor for recovering energy from the PDP reaches a maximum value and then, becomes 0 in the third period.

6. The plasma display device of claim 5, wherein the magnitude of the current that flows through the inductor for recovering energy from the PDP at the point of time where the second switch is turned on is 0.55 times to 0.90 times the maximum value.

7. The plasma display device of claim 5, wherein the magnitude of the current that flows through the inductor for recovering energy from the PDP at the point of time where the second switch is turned on is 0.55 times to 0.75 times the maximum value.

8. The plasma display device of claim 1, wherein the number of scan electrode lines or the number of sustain electrodes that are formed in the PDP is no less than 1,080.

9. The plasma display device of claim 1, wherein the width of the scan signals supplied to the panel is no more than 1.5 μs.

10. The plasma display device of claim 1, wherein the width of the scan signals supplied to the PDP is 0.7 μm to 1.1 μs.

11. The plasma display device of claim 1, wherein a positive polar voltage is supplied to the address electrodes in the period where the sustain signals are supplied.

12. The plasma display device of claim 1, wherein the lowest voltage of reset signals supplied to scan electrodes formed in the PDP in a reset period is higher than the lowest voltage of the scan signals supplied to the scan electrodes in an address period.

13. The plasma display device of claim 1, wherein a positive polar bias voltage is supplied to sustain electrodes formed in the PDP in an at least partial period of the reset period and the address period, and wherein the positive polar bias voltage supplied to the sustain electrodes has a value no less than 2.

14. The plasma display device of claim 1, wherein the plurality of sustain signals are supplied to the PDP in a sustain period, and wherein a width of a last sustain signal among the plurality of sustain signals is larger than a width of remaining sustain signals.

15. The plasma display device of claim 1, wherein an inductor for supplying energy to the PDP is the same as an inductor for recovering energy from the PDP.

16. The plasma display device of claim 1, wherein the inductor for supplying energy to the PDP is different from the inductor for recovering energy from the PDP.

17. A plasma display device comprising a plasma display panel (PDP) and a driving unit for generating driving signals for driving the PDP, wherein the driving unit comprises an energy recovery circuit comprising at least one inductor, a first switch, and a second switch, wherein a period in which sustain signals are supplied to the PDP comprises a first period in which energy is supplied from the inductor to the PDP and the first switch is turned off, a second period in which the first switch is turned on so that a sustain voltage is supplied to the PDP, a third period in which energy is recovered from the PDP to the inductor and the second switch is turned off, and a fourth period in which the second switch is turned on to supply the reference voltage to the PDP, wherein a length of the first period is shorter than a length of the third period, and wherein the first switch is turned on at a point of time where a magnitude of current that flows through the inductor for supplying energy the PDP reaches a maximum value and then, becomes 0.5 times to 0.85 times the maximum value in the first period.

18. The plasma display device of claim 17, wherein the second switch is turned on at a point of time where a magnitude of current that flows through the inductor for recovering energy from the PDP reaches a maximum value, and then becomes 0.55 times to 0.90 times the maximum value in the third period.

19. The plasma display device of claim 17, wherein the length of the first period is 0.21 times to 0.48 times the length of the third period.

20. A plasma display device comprising a plasma display panel (PDP) and a driving unit for generating driving signals for driving the PDP, wherein the driving unit comprises an energy recovery circuit comprising at least one inductor, a first switch, and a second switch, wherein a period in which sustain signals are supplied to the PDP comprises a first period in which energy is supplied from the inductor to the PDP and the first switch is turned off, a second period in which the first switch is turned on so that a sustain voltage is supplied to the PDP, a third period in which energy is recovered from the PDP to the inductor and the second switch is turned off, and a fourth period in which the second switch is turned on to supply the reference voltage to the PDP, and wherein the first switch is turned on at a point of time where a magnitude of current that flows through the inductor for supplying energy to the PDP reaches a maximum value and then, becomes 0.5 times to 0.85 times the maximum value in the first period.

* * * * *